US012497253B2

(12) United States Patent
Takechi

(10) Patent No.: US 12,497,253 B2
(45) Date of Patent: Dec. 16, 2025

(54) ARTICLE SUPPORTER, SUPPLY DEVICE, AND IMAGE FORMING APPARATUS

(71) Applicant: Konica Minolta, Inc., Tokyo (JP)

(72) Inventor: Taro Takechi, Kunitachi (JP)

(73) Assignee: Konica Minolta, Inc., Tokyo (JP)

( * ) Notice: Subject to any disclaimer, the term of this patent is extended or adjusted under 35 U.S.C. 154(b) by 242 days.

(21) Appl. No.: 18/130,221

(22) Filed: Apr. 3, 2023

(65) Prior Publication Data

US 2023/0348214 A1 Nov. 2, 2023

(30) Foreign Application Priority Data

Apr. 28, 2022 (JP) ..... 2022-074640

(51) Int. Cl.

| | |
|---|---|
| ***B65H 3/12*** | (2006.01) |
| ***B65H 1/14*** | (2006.01) |
| ***B65H 3/48*** | (2006.01) |
| ***B65H 7/04*** | (2006.01) |

(52) U.S. Cl.

CPC ..... *B65H 3/128* (2013.01); *B65H 1/14* (2013.01); *B65H 3/48* (2013.01); *B65H 7/04* (2013.01); *B65H 2406/10* (2013.01); *B65H 2406/323* (2013.01); *B65H 2701/1916* (2013.01)

(58) Field of Classification Search

CPC ..... B65H 3/12; B65H 3/124; B65H 3/128; B65H 1/04; B65H 1/12; B65H 1/14; B65H 2405/11152; B65H 2405/111; B65H 2405/1112; B65H 2405/1117; B65H 2406/32; B65H 2406/323; B65H 2801/06

USPC ..... 271/90

See application file for complete search history.

(56) References Cited

U.S. PATENT DOCUMENTS

| | | | | |
|---|---|---|---|---|
| 5,364,087 A | | 11/1994 | Schieck et al. | |
| 6,123,329 A | * | 9/2000 | Sato | B65H 1/266 271/145 |
| 6,283,469 B1 | * | 9/2001 | Weber | B65H 1/14 271/160 |
| 7,913,993 B2 | * | 3/2011 | Kosugi | B65H 3/48 271/98 |

(Continued)

FOREIGN PATENT DOCUMENTS

JP 2016-204080 A 12/2016

OTHER PUBLICATIONS

Extended European Search Report (EESR) dated Sep. 25, 2023 issued in European application No. 23170025.3.

*Primary Examiner* — Leslie A Nicholson, III
(74) *Attorney, Agent, or Firm* — RANKIN, HILL & CLARK LLP

(57) ABSTRACT

An article supporter for a supply device includes a feeder that supplies, by air suction, an uppermost thinly tabular article from a bundle of a plurality of thinly tabular articles that is stacked and is partially different in thickness, the article supporter for supporting the bundle with a gap between the uppermost thinly tabular article and the feeder, and the article supporter includes: a first support that supports respective thinner parts of the plurality of thinly tabular articles; a second support that supports respective thicker parts of the plurality of thinly tabular articles and is movable upward and downward; and an adjuster that adjusts a level of the second support such that the uppermost thinly tabular article of the bundle is set within a predetermined range in a vertical direction.

15 Claims, 13 Drawing Sheets

(56) References Cited

U.S. PATENT DOCUMENTS

| | | | | |
|---|---|---|---|---|
| 8,177,223 | B2 * | 5/2012 | Bauer | B65H 1/14 271/145 |
| 8,191,889 | B1 | 6/2012 | Cummings et al. | |
| 8,480,073 | B1 * | 7/2013 | Ishikawa | B65H 3/18 271/18.2 |
| 8,628,075 | B2 * | 1/2014 | De La Hamayde | B65H 1/14 271/30.1 |
| 10,494,207 | B2 * | 12/2019 | Niikura | B65H 1/04 |
| 11,279,575 | B2 * | 3/2022 | Hayasaka | B65H 1/08 |
| 12,043,502 | B2 * | 7/2024 | Hayasaka | B65H 3/128 |
| 2020/0102166 | A1 | 4/2020 | Hayasaka et al. | |

* cited by examiner

ARTICLE SUPPORTER, SUPPLY DEVICE, AND IMAGE FORMING APPARATUS

The entire disclosure of Japanese patent Application No. 2022-074640, filed on Apr. 28, 2022, is incorporated herein by reference in its entirety.

BACKGROUND

Technological Field

The present invention relates to an article supporter that supports a thinly tabular article, a supply device including the article supporter, and an image forming apparatus.

Description of the Related Art

Regarding to an image forming apparatus, JP 2016-204080 A discloses a technique of detecting the rear end of an envelope in the tray accommodating the envelope to be an image forming target.

Such an image forming apparatus has a tray that accommodates thinly tabular articles as a bundle of stacked articles. In a case where a thinly tabular article is partially different in thickness such as an envelope, the uppermost thinly tabular article in the bundle is inclined due to stacking of the articles difference in thickness. The inclined thinly tabular article may interfere with the outward supply from the tray. Thus, the number of stacked thinly tabular articles is limited to a small number.

SUMMARY

The present invention has been made in view of the above points. An object of the present invention is to provide an article supporter capable of suitably supporting a bundle of a plurality of thinly tabular articles that is stacked and is partially different in thickness, a supply device, and an image forming apparatus.

To achieve the abovementioned object, according to an aspect of the present invention, there is provided an article supporter for a supply device including a feeder that supplies, by air suction, an uppermost thinly tabular article from a bundle of a plurality of thinly tabular articles that is stacked and is partially different in thickness, the article supporter for supporting the bundle with a gap between the uppermost thinly tabular article and the feeder, the article supporter reflecting one aspect of the present invention comprises: a first support that supports respective thinner parts of the plurality of thinly tabular articles; a second support that supports respective thicker parts of the plurality of thinly tabular articles and is movable upward and downward; and an adjuster that adjusts a level of the second support such that the uppermost thinly tabular article of the bundle is set within a predetermined range in a vertical direction.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments. In the reference drawings, "front and rear" indicates a feeding direction of a thinly tabular article (the downstream side as front and the upstream side as rear), and "left and right" indicates a width direction of the thinly tabular article (a direction orthogonal to the feeding direction and the up-and-down direction).

<Supply Device>

Figure 1:
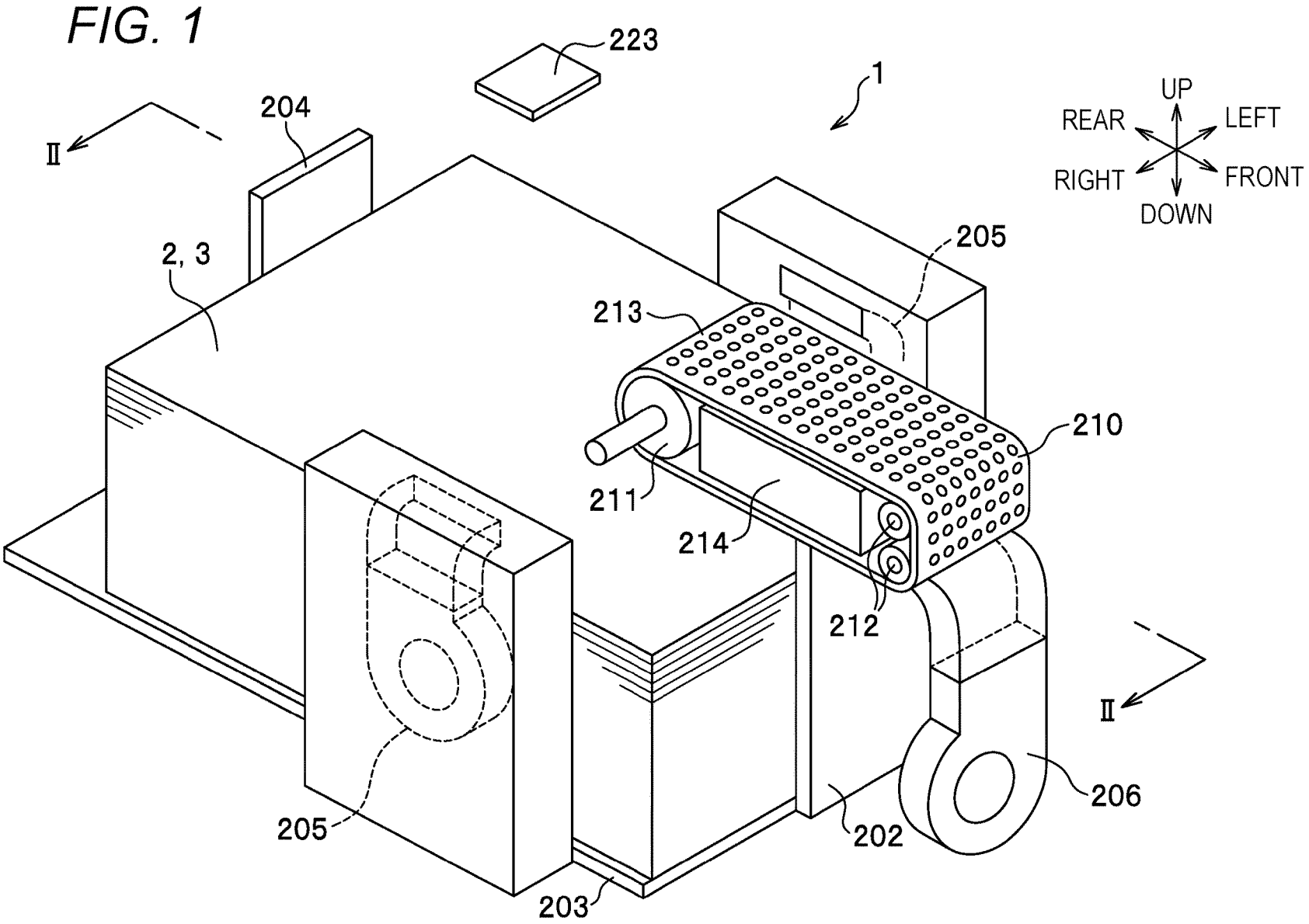
FIG. 1 is a perspective view schematically illustrating a supply device according to an embodiment of the present invention.
Figure 2:
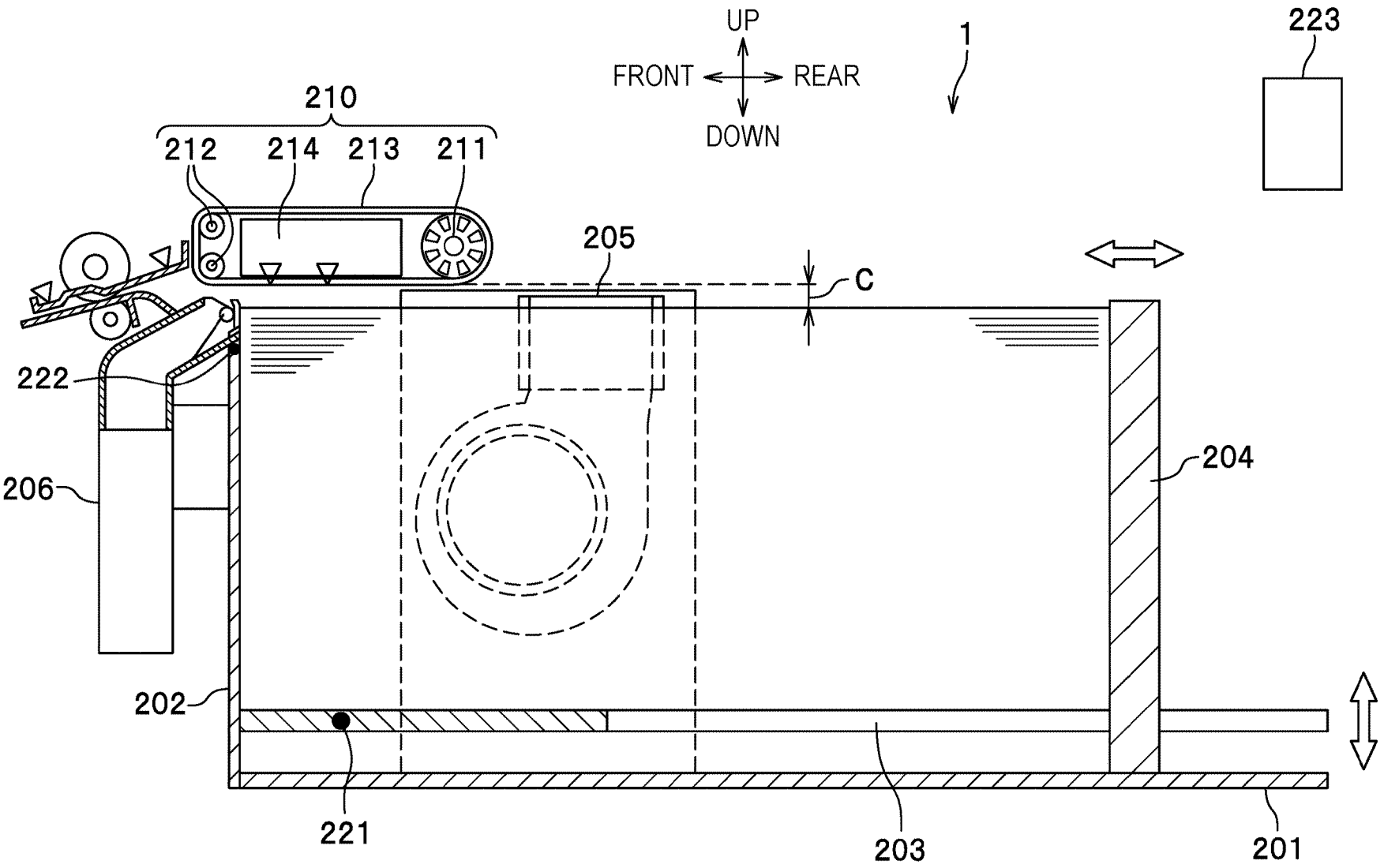
FIG. 2 is a side view (cross-sectional view taken along line II-II in FIG. 1) schematically illustrating the supply device according to the embodiment of the present invention.

As illustrated in FIGS. 1 and 2, a supply device 1 according to an embodiment of the present invention is of an air separation type. The supply device 1 blows air to a plurality of thinly tabular articles 2 stacked in the up-and-down direction to float and separate each thinly tabular article 2, and then conveys the separated thinly tabular article 2 to supply outward. The supply device 1 includes, as a basic configuration, a bottom wall 201, a front wall 202, a lifting plate 203, a position regulator 204, a pair of left and right floaters 205 and 205, a front floater 206, and a feeder 210. The supply device 1 further includes sensors 221 and 222, and a controller 223.

<<Bottom Wall>>

The bottom wall 201 extending horizontally (frontward and rearward, and leftward and rightward) serves as a floor face of the supply device 1.

<<Front Wall>>

The front wall 202 extends upward from the front end of the bottom wall 201. The front wall 202 serves as a position regulator that regulates the position of the respective front ends of the thinly tabular articles 2 provided on the lifting plate 203 (i.e., frontward movement of the thinly tabular article 2).

<<Lifting Plate>>

The lifting plate 203 provided above the bottom wall 201 extends horizontally, and is a tabular metal member movable upward and downward. The lifting plate 203 has, for example, a hole and a cutaway for allowing movement of the position regulator 204 and each floater 205.

<<Position Regulator>>

The position regulator 204 protrodes upward the lifting plate 203 on the upper side of the bottom wall 201. The position regulator 204 regulates the position of the respective rear ends of the thinly tabular articles 2 provided on the lifting plate 203 (i.e., rear movement of the thinly tabular article 2.) The position regulator 204 manually movable frontward and rearward with respect to the bottom wall 201 can correspond to thinly tabular articles 2 various in size.

<<Floater>>

Each of the pair of floaters 205 and 205 protrodes upward the lifting plate 203 on the upper side of the bottom wall 201, and serves as a fan that blows air from the corresponding side to the uppermost thinly tabular article 2 of the thinly tabular articles 2 provided on the lifting plate 203 to float the thinly tabular article 2. The floater 205 manually movable leftward and rightward with respect to the bottom wall 201 can correspond to thinly tabular articles 2 various in size. The floater 205 is accommodated in the corresponding housing serving as a position regulator that regulates the position of the respective ends in the width direction of the thinly tabular articles 2 provided on the lifting plate 203 (i.e., movement in the width direction of the thinly tabular articles 2).

<<Floater>>

The floater 206 serves a fan that blows air from the front of the uppermost thinly tabular article 2 of the thinly tabular articles 2 provided on the lifting plate 203 to float the thinly tabular article 2.

<<Feeder>>

The feeder 210 provided above the front wall 202 conveys the thinly tabular article 2 floated by the floater 206 with the floated thinly tabular article 2 sucked by air to feed the sucked thinly tabular article 2 outward (frontward) the supply device 1. The feeder 210 includes a driving roller 211, a driven roller 212, a suction belt 213 as an endless belt that has a plurality of holes and is wound around the driving roller 211 and the driven roller 212, and a sucker 214 provided on the inner circumferential side of the suction belt 213.

<<Sensor>>

The sensor 221 provide at the lifting plate 203 detects (presence or absence of) the thinly tabular article 2 provided above the sensor 221 to output the detection result to the controller 223. The sensor 222 provided at the upper part of the front wall 202 detects (presence or absence of) the thinly tabular article 2 present at the same level as the sensor 222 to output the detection result to the controller 223.

<<Controller>>

The controller 223 includes a central processing unit (CPU), a read-only memory (ROM), a random access memory (RAM), and an input/output circuit. In response to detection of the thinly tabular articles 2 by the sensor 221, the controller 223 controls a mechanism such as a motor (not illustrated) to cause the lifting plate 203 to lift. Here, in response to the detection of the thinly tabular articles 2 by the sensor 222, the controller 223 stops the mechanism (not illustrated) to set the lifting plate 203 (i.e., the uppermost thinly tabular article 2) to a desired level. The gap C between the uppermost thinly tabular article 2 and the feeder 210 (the lower face of the suction belt 213) is set to a predetermined value. In such a state, the floaters 205 and 206 can blow air to the uppermost thinly tabular article 2. The suction belt 213 locates above the uppermost thinly tabular article 2 by a predetermined level.

Subsequently, the controller 223 controls the floaters 205 and 206 to float the uppermost thinly tabular article 2. Further, the controller 223 controls the sucker 214 to suck the floated thinly tabular article 2 such that the floated thinly tabular article 2 is sucked onto the suction belt 213 (by air suction), and controls, for example, a motor for rotating the driving roller 211, so that the thinly tabular article 2 sucked on the suction belt 213 is conveyed and supplied outward the supply device 1 while being conveyed.

<Article Supporter Set>

Figure 3:
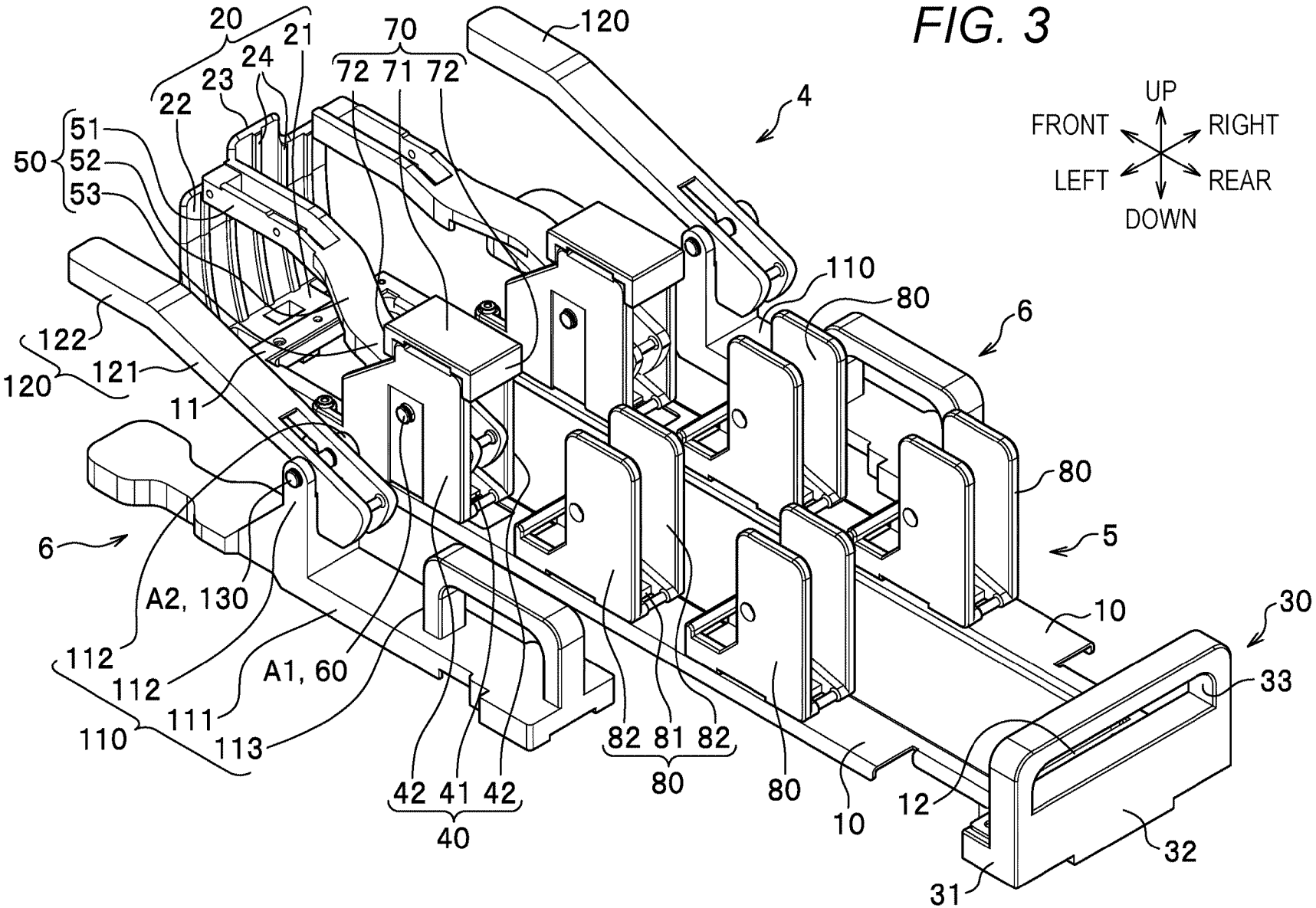
FIG. 3 is a perspective view schematically illustrating an article supporter set for use in the supply device according to the embodiment of the present invention.
Figure 4:
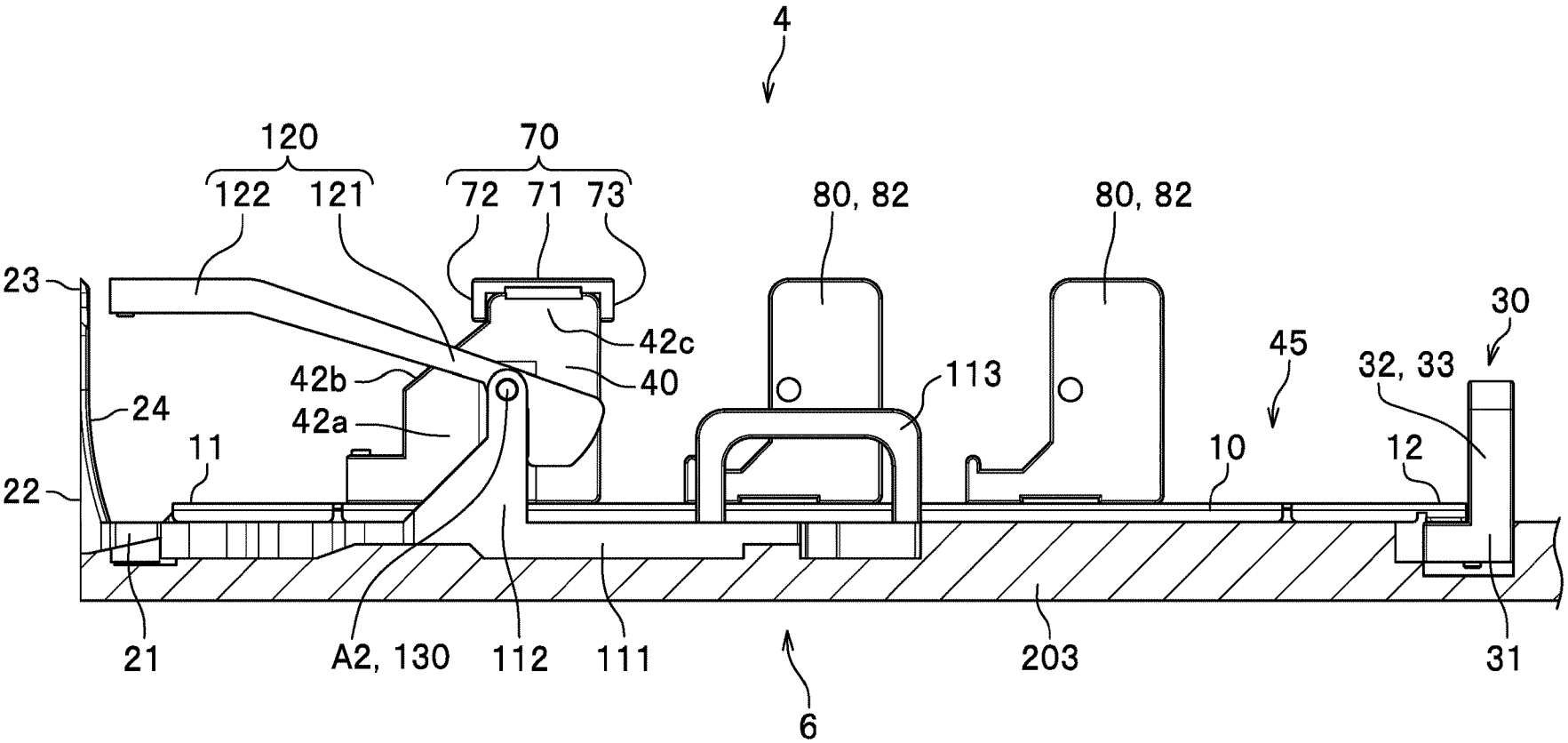
FIG. 4 is a side view schematically illustrating the article supporter set for use in the supply device according to the embodiment of the present invention.

As illustrated in FIGS. 3 and 4, in order for the supply device 1 supplying, such as an envelope, a thinly tabular article 2 partially different in thickness, the article supporter set 4 according to the embodiment of the present invention is provided on the lifting plate 203 to support the bundle 3 as a stacked body including a plurality of thinly tabular articles 2. The article supporter set 4 includes an article supporter 5, and a pair of auxiliary article supporters 6 and 6.

<Article Supporter>

The article supporter 5 includes a pair of bases 10 and 10, a position regulator 20, and a coupler 30. The article supporter 5 further includes, for each base 10, a first support 40, a second support 50, an adjuster 60, a raising member 70, and a pair of front and rear third supports 80 and 80.

<Base>

Each of the pair of bases 10 and 10 is an elongated tabular metal member extending in the feeding direction of the thinly tabular article 2, that is, frontward and rearward. Each of the pair of bases 10 and 10 is securable to the lifting plate 203 by magnetic force. The one of the pair of bases 10 and 10 and the other are provided in parallel to each other at a predetermined interval in the width direction. In the present embodiment, the pair of bases 10 and 10 are two sides that are each a metal member having a rectangular frame shape and that faces each other. That is, the respective front ends of the pair of bases 10 and 10 are integrally connected through a front side part 11 extending in the width direction, and the respective rear ends of the pair of bases 10 and 10 are integrally connected through a rear side part 12 extending in the width direction.

<Position Regulator>

The position regulator 20 is a resin member coupling the front ends of the pair of bases 10 and 10 to each other, and regulates the position of the front end of the bundle 3 as the stacked body including the plurality of thinly tabular articles 2 supported by the article supporter 5. The position regulator 20 integrally includes a bottom wall 21, a front wall 22 extending upward from the front end of the bottom wall 21, and an extending wall 23 extending upward from an intermediate part in the width direction of the upper end of the front wall 22. The rear end of the bottom wall 21 is secured to the front ends of the pair of bases 10 and 10 and the front side part 11. The respective rear faces of the front wall 22 and the extending wall 23 each are arc-shaped about pivotal shafts A1 and A2 in side view.

The position regulator 20 includes a plurality of ribs 24 each erected rearward from the rear faces of the front wall 22 and the extending wall 23. The plurality of ribs 24 each extend upward and downward and are disposed at equal intervals in the width direction. The respective leading ends (rear end faces) of the plurality of ribs 24 are each arc-shaped about the pivotal shafts A1 and A2 in side view.

<Coupler>

The coupler 30 is a resin member coupling the rear ends of the pair of bases 10 and 10 to each other. The coupler 30 integrally includes a bottom wall 31 and a rear wall 32 extending upward from the rear end of the bottom wall 31. The front end of the bottom wall 31 is secured to the rear ends of the pair of bases 10 and 10 and the rear side part 12. The rear wall 32 has an upper part provided with a handle 33. The handle 33 having a hole penetrating the rear wall 32 frontward and rearward is grippable by the user.

The coupler 30 includes a lower protrusion extending downward from the bottom wall 31. The lower protrusion is internally fitted into a groove extending frontward and rearward at a central part in the width direction of the lifting plate 203, thereby regulating movement of the coupler 30 in the width direction and positioning the article supporter 5 in the width direction.

<First Support>

Such a first support 40 as described above is a resin member integrally including a bottom wall 41 and a pair of side walls 42 and 42 extending upward, one-to-one, from both ends of the bottom wall 41 in the width direction. The bottom wall 41 is substantially the same in width dimension as the base 10, and is attached to an intermediate part in the longitudinal direction of the base 10. The first support 40 supports a portion where the respective thinner parts 2X of the thinly tabular articles 2 of the bundle 3 are superimposed on the respective upper faces of the pair of side walls 42 and 42 (see FIG. 8).

Each side wall 42 integrally includes a lower part 42*a*, an inclined part 42*b*, and an upper part 42*c*. The lower part 42*a* is wide in width in the front-and-rear direction. The inclined part 42*b* extends upward from the upper end of the lower part 42*a*, narrows upward in width, and has a front side inclining rearward. The upper part 42*c* extends upward from the inclined part 42*b* and is narrower in width than the lower part 42*a* in the front-and-rear direction. The inclined part 42*b* is a part provided for avoiding interference with an intermediate part 52 of the second support 50. The upper part 42*c* is a part to which the raising member 70 to be described later is attached.

<Second Support>

Such a second support 50 described above extends frontward and rearward and is a resin member integrally including a base end 51, the intermediate part 52, and a leading end 53 in this order from the rear. The base end 51 is accommodated between the pair of side walls 42 and 42, and is journaled pivotally around the pivotal shaft A1 to the pair of side walls 42 and 42. With no bundle 3 supported, the base end 51 inclines upward from rear to front in side view. With no bundle 3 supported, the intermediate part 52 inclines upward from rear to front in side view. The intermediate part 52 inclines inward in the width direction from rear to front in plan view. With no bundle 3 supported, the leading end 53 extends almost horizontally in side view. The second support 50 supports a portion where the respective thicker parts 2Y of the thinly tabular articles 2 of the bundle 3 are superimposed on the upper face of the leading end 53 (see FIG. 8). Further, at least either the first support 40 or the second support 50 is provided with a pivotal regulator that regulates, with no bundle 3 supported, pivoting of the second support 50 such that the leading end 53 does not move upward from its horizontal position.

The leading end 53 includes a sensor holder 53*a* as a recess capable of holding a sensor 221, and a through hole 53*b* with which the bottom face of the sensor holder 53*a* is provided. The sensor 221 is detachably attached to each of the lifting plate 203 and the sensor holder 53*a* of the leading end 53. The sensor 221 accommodated and held in the sensor holder 53*a* is connected to the controller 223 through a wired line passing through the through hole 53*b*.

<Adjuster>

The adjuster 60 adjusts the level of the leading end 53 of the second support 50 such that the uppermost thinly tabular article 2 of the bundle 3 is set within a predetermined range R (see FIG. 9) in the vertical direction. That is, the difference in level between the positions in the plane of the uppermost thinly tabular article 2 is set within the predetermined range R, and thus the uppermost thinly tabular article 2 is in a substantially horizontal posture. On the other hand, the lowermost thinly tabular article 2 is supported by the first support 40 (raising member 70) and the second support 50 different in level. The difference in level between the positions in the plane of the lowermost thinly tabular article 2 is out of the predetermined range R, and thus the lowermost thinly tabular article 2 is in an inclined posture. In the present embodiment, the adjuster 60 serving as an urging member that elastically urges the second support 50 upward is, for example, a wound spring with which the pivotal shaft A1 of the second support 50 is provided.

The predetermined range R corresponds to a value set in advance on the basis of, for example, the thickness of the thinly tabular article 2 as a target or the dimension in the up-and-down direction of the passage to which the thinly tabular article 2 as the target is supplied. At the article supporter 5, for example, the urging force of each adjuster 60 and the distance between the side walls 42 and 42 of each first support 40 and the leading end 53 of the corresponding second support 50 are appropriately set such that the uppermost thinly tabular article 2 is set within the predetermined range R.

The adjuster 60 adjusts the level of the leading end 53 of the second support 50 such that the difference in level between the thinner part 2X and the thicker part 2Y of the uppermost thinly tabular article 2 of the bundle 3 is smaller than the difference in level between the thinner part 2X and the thicker part 2Y of the lowermost thinly tabular article 2 of the bundle 3.

<Raising Member>

The raising member 70 is a resin member detachably attached to the upper ends of the pair of side walls 42 and 42 of the first support 40. The raising member 70 integrally includes an upper wall 71, a front wall 72 extending downward from the front end of the upper wall 71, and a rear wall 73 extending downward from the rear end of the upper wall 71. The raising member 70 is fitted to the side walls 42 and 42 such that the raising member 70 is disabled from moving frontward and rearward.

<Third Support>

Such a third support 80 described above is a resin member integrally including a bottom wall 81, a pair of side walls 82 and 82 extending upward, one-to-one, from both ends of the bottom wall 81 in the width direction. The bottom wall 81 is substantially the same in width dimension as the base 10, and is detachably attached to the rear in the longitudinal direction of the base 10. The third support 80 is provided behind the first support 40, and supports a portion where the respective thinner parts 2X of the thinly tabular articles 2 of the bundle 3 are superimposed on the upper face of the side wall 82 (see FIG. 8).

<Auxiliary Article Supporter>

Such an auxiliary article supporter 6 as described above is provided outside in the width direction of the article supporter 5, and includes a base 110, a support 120, and an adjuster 130.

<Base>

The base 110 is a resin member integrally including an elongated tabular bottom wall 111 extending frontward and rearward, a pair of side walls 112 and 112 extending upward, one-to-one, from both ends in the width direction at an intermediate part of the bottom wall 111 in the front-and-rear direction, and a handle 113 extending upward at the rear of the bottom wall 111. The bottom wall 111 has a lower face on which, for example, a metal piece securable to the lifting plate 203 by magnetic force may be attached.

<Support>

The support 120 extends frontward and rearward, and integrally includes a base 121 and a leading end 122 in this order from the rear. The base 121 has a rear end accommodated between the pair of side walls 112 and 112, and is journaled pivotally around the pivotal shaft A2 to the pair of side walls 112 and 112. With no bundle 3 supported, similarly to the base end 51 and the intermediate part 52 of the second support 50, the base 121 inclines upward from rear to front in side view. With no bundle 3 supported, similarly to the leading end 53 of the second support 50, the leading end 122 extends almost horizontally in side view. The support 120 supports a portion where the thicker parts 2Y of the thinly tabular articles 2 of the bundle 3 are superimposed on the upper face of the leading end 122 (see FIG. 8). Further, at least either the base 110 or the support 120 is provided with a pivotal regulator that regulates, with no bundle 3 supported, pivoting of the support 120 such that the leading end 122 does not move upward from its horizontal position.

<Adjuster>

The adjuster 130 adjusts the level of the leading end 122 of the support 120 such that the uppermost thinly tabular article 2 of the bundle 3 is set within the predetermined range R (see FIG. 9) in the vertical direction. In the present embodiment, the adjuster 130 is as an urging member that elastically urges the support 120 upward and is, for example, a wound spring with which the pivotal shaft A2 of the support 120 is provided.

<Relationship between Position and Level of Support>

With no bundle 3 supported, the upper face of the upper wall 71 of the raising member 70 externally fitted to the side walls 42 and 42 of each first support 40, the upper face of the leading end 53 of the corresponding second support 50, the upper faces of the side walls 82 and 82 of the corresponding third support 80, the upper face of the leading end 122 of the corresponding support 120, and the upper edge of the extending wall 23 are set at the same level. The leading end 53 of the second support 50 and the leading end 122 of the support 120 are at the same position in the front-and-rear direction and are arrayed in the width direction. The interval between the leading ends 53 of the pair of second supports 50 and 50 is smaller than the interval between the inner side walls 42 and 42 of the pair of first supports 40 and 40 and the interval between the inner side walls 82 and 82 of the pair of third supports 80 and 80. In other words, the interval between the pair of first supports 40 and 40 and the interval between the pair of third supports 80 and 80 are set at a dimension in which the position regulator 204 can be disposed.

<Longitudinally-Long Open-End Envelope>

Figure 5:
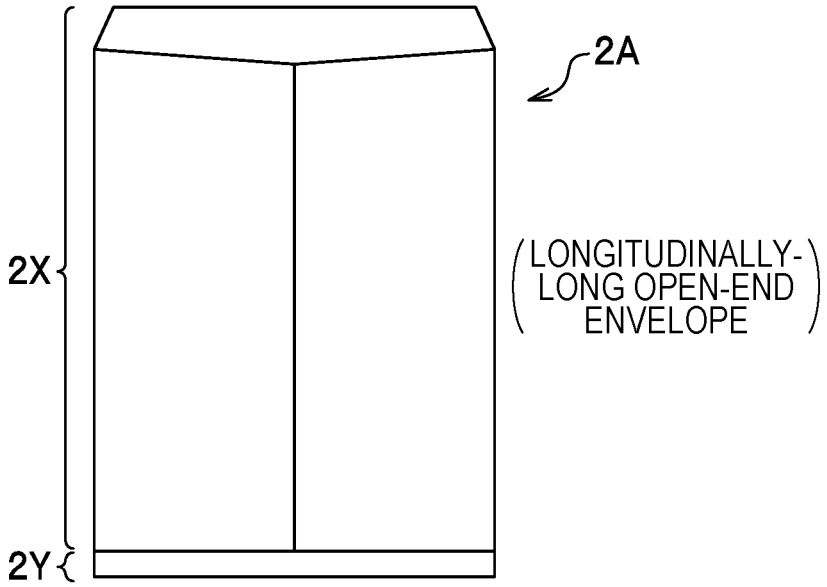
FIG. 5 is a rear view schematically illustrating a longitudinally-long open-end envelope as an exemplary thinly tabular article.

As illustrated in FIG. 5, in a direction orthogonal to the width direction, a longitudinally-long open-end envelope 2A as an exemplary thinly tabular article 2 has, as a thicker part 2Y, a bottom closed due to an overlapping margin and a part as a thinner part 2X different from the bottom.

<Center-Seam Elongated Open-end Envelope>

Figure 6:
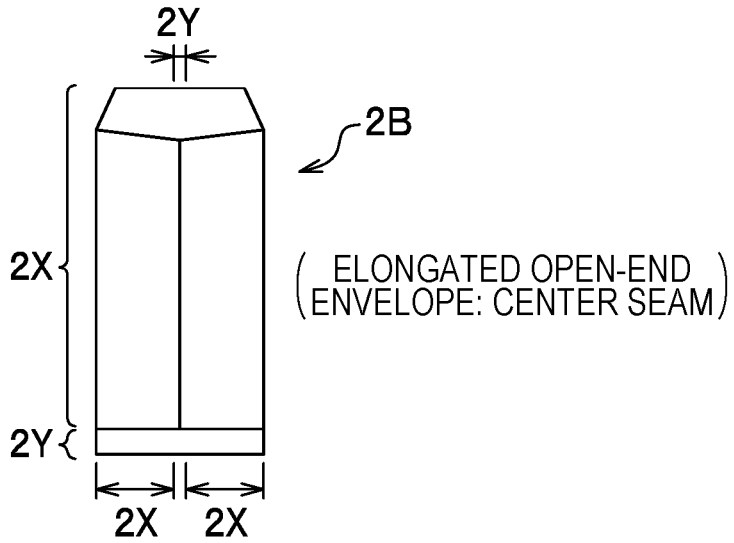
FIG. 6 is a rear view schematically illustrating a center-seam elongated open-end envelope as an exemplary thinly tabular article.

As illustrated in FIG. 6, in a direction orthogonal to the width direction, a center-seam elongated open-end envelope 2B as an exemplary thinly tabular article 2 has, as a thicker part 2Y, a bottom closed portion due to an overlapping margin and a part as a thinner part 2X different from the bottom. The center-seam elongated open-end envelope 2B further has, as a thicker part 2Y, a central part in the width direction closed due to an overlapping margin and the remaining part as a thinner part 2X different from the thicker part 2Y.

<Single-Side-Seam Elongated Open-End Envelope>

Figure 7:
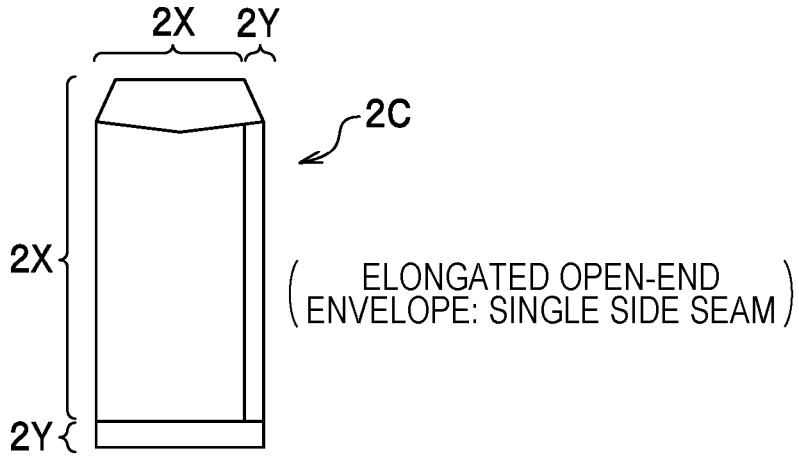
FIG. 7 is a rear view schematically illustrating a single-side-seam elongated open-end envelope as an exemplary thinly tabular article.

As illustrated in FIG. 7, in a direction orthogonal to the width direction, a single-side-seam elongated open-end envelope 2C as an exemplary thinly tabular article 2 has, as a thicker part 2Y, a bottom part closed due to an overlapping margin and a part as a thinner part 2X different from the bottom. The single-side-seam elongated open-end envelope 2C further has, as a thicker part 2Y, one end in the width direction closed due to an overlapping margin and the remaining part as a thinner part 2X different from the thicker part 2Y.

<Technique of Supporting (Longitudinally-Long) Open-End Envelope>

Figure 8:
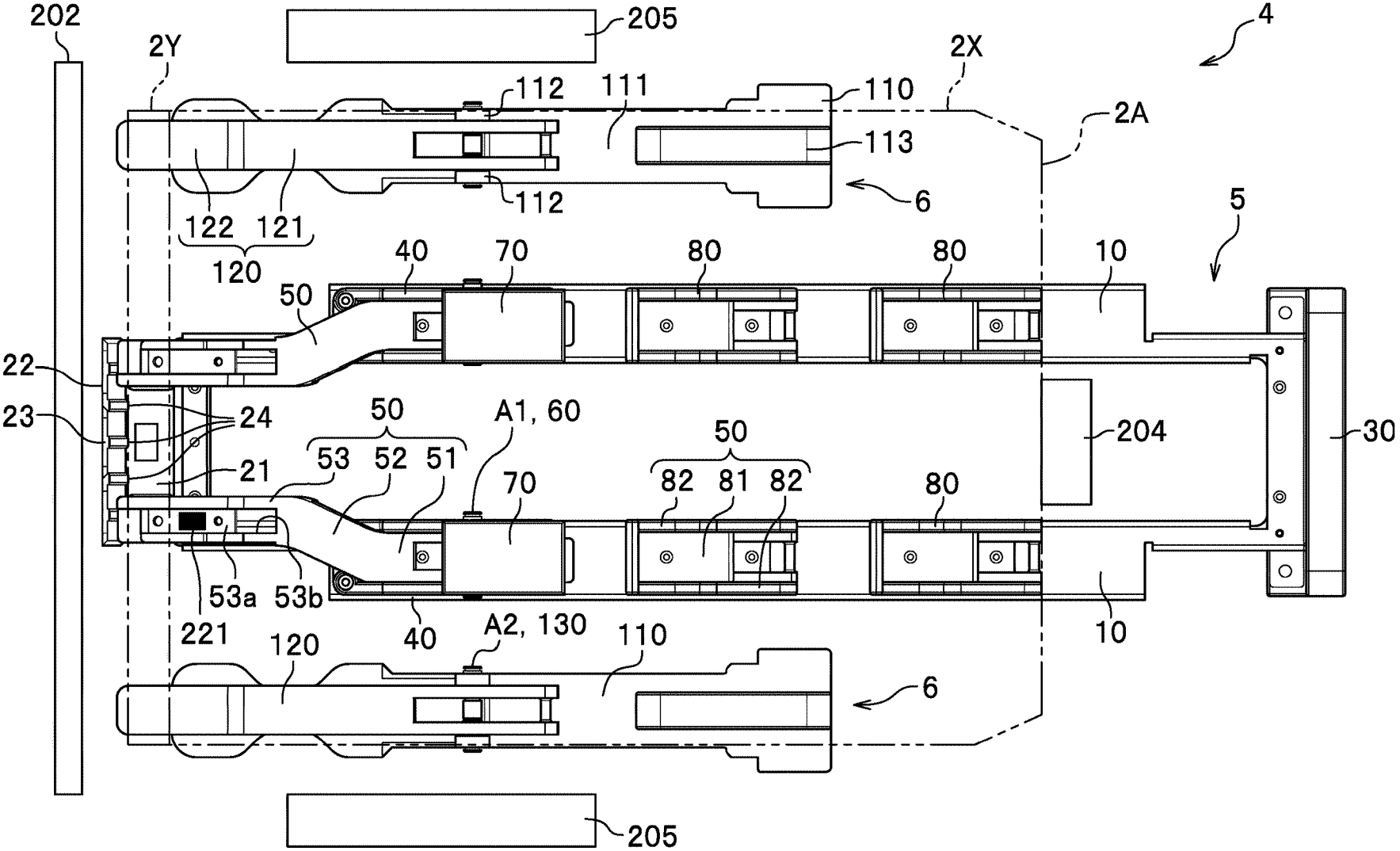
FIG. 8 is a plan view schematically illustrating an example that a longitudinally-long open-end envelope end is supported by the article supporter set according to an embodiment of the present invention.
Figure 9:
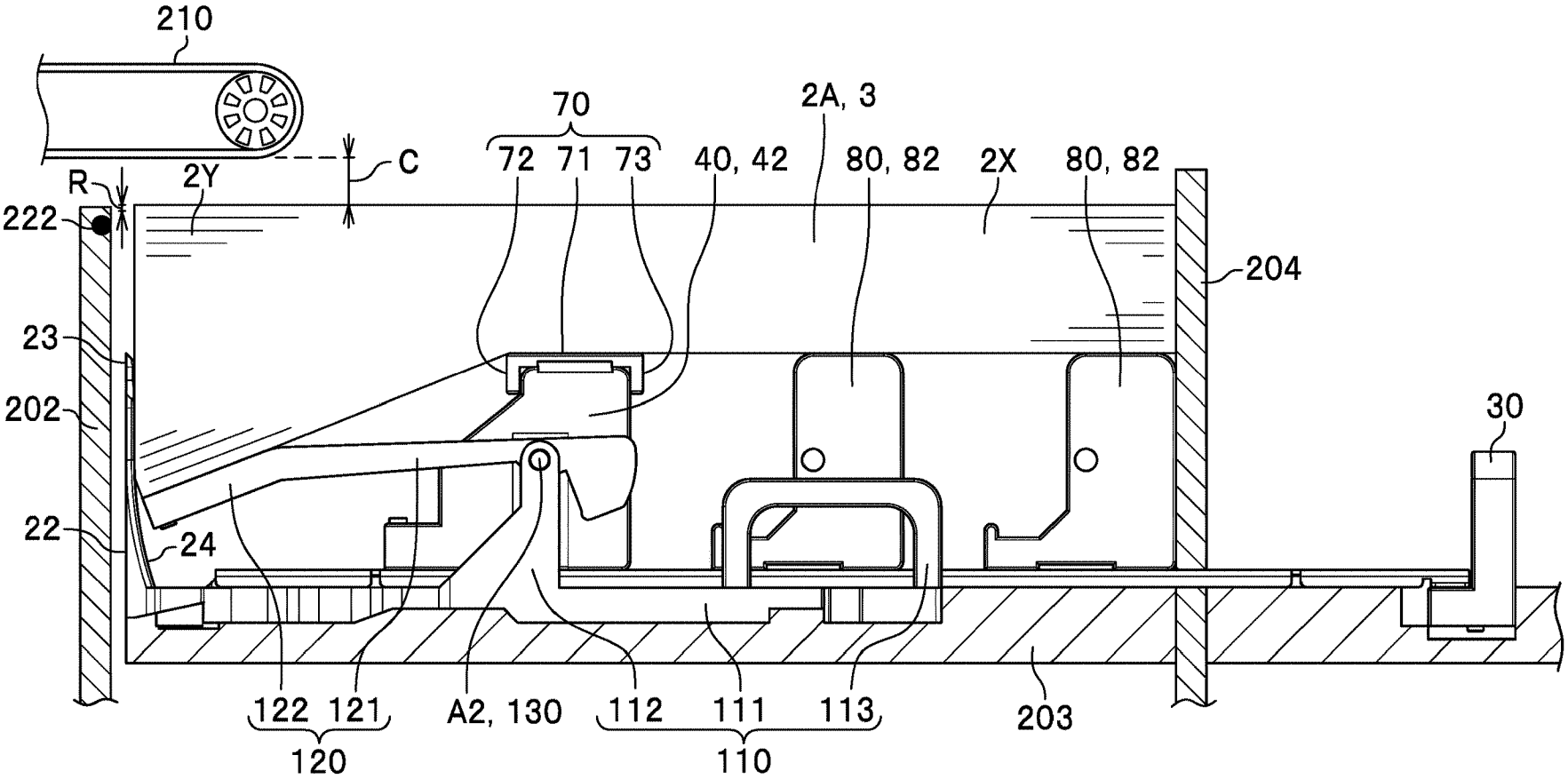
FIG. 9 is a side view schematically illustrating an example that the longitudinally-long open-end envelope is supported by the article supporter set according to the embodiment of the present invention.

As illustrated in FIGS. 8 and 9, a bundle 3 of longitudinally-long open-end envelopes 2A stacked is supported by the article supporter set 4, and is positioned by each first support 40, and the position regulator 204 and the floaters 205 and 205 with the positions adjusted in response to the size of the longitudinally-long open-end envelopes 2A. Of the bundle 3 of the longitudinally-long open-end envelopes 2A stacked, a portion with the thinner parts 2X superimposed is placed and supported on the upper wall 71 of the corresponding raising member 70 provided on the first support 40 and the side walls 82 and 82 of each of the corresponding pair of third supports 80 and 80. Further, of the bundle 3 of the longitudinally-long open-end envelopes 2A stacked, a portion with the thicker parts 2Y superimposed is placed and supported on the leading end 53 of each second support 50 and the leading end 122 of the corresponding support 120. Here, due to the weight of the thicker parts 2Y, the second support 50 pivots around the pivotal shaft A1 such that the leading end 53 is lowered while resisting the urging force of the corresponding adjuster 60. Further, due to the weight of the thicker parts 2Y, the support 120 pivots around the pivotal shaft A2 such that the leading end 122 is lowered while resisting the urging force of the corresponding adjuster 130. In such a state, (the respective upper faces of) the leading ends 53 and 122 inclining downward from rear to front in side view support the portion with the thicker parts 2Y superimposed of the bundle 3.

In such a state, of the lowermost open-end envelope 2A of the bundle 3, the thicker part 2Y is lower in position than the thinner part 2X. Of the uppermost open-end envelope 2A of the bundle 3, the thicker part 2Y is substantially the same in level as the thinner part 2X. That is, in the uppermost open-end envelope 2A, the positions of the thinner part 2X and the thicker part 2Y in the vertical direction fall within a predetermined range R (almost horizontal). That is, with the bundle 3 supported by the article supporter set 4, the difference in level between the thinner part 2X and the thicker part 2Y of the uppermost open-end envelope 2A of the bundle 3 is smaller than the difference in level between the thinner part 2X and the thicker part 2Y of the lowermost open-end envelope 2A of the bundle 3. The gap C between the uppermost open-end envelope 2A of the bundle 3 and the feeder 210 is set at a predetermined value.

Figure 10:
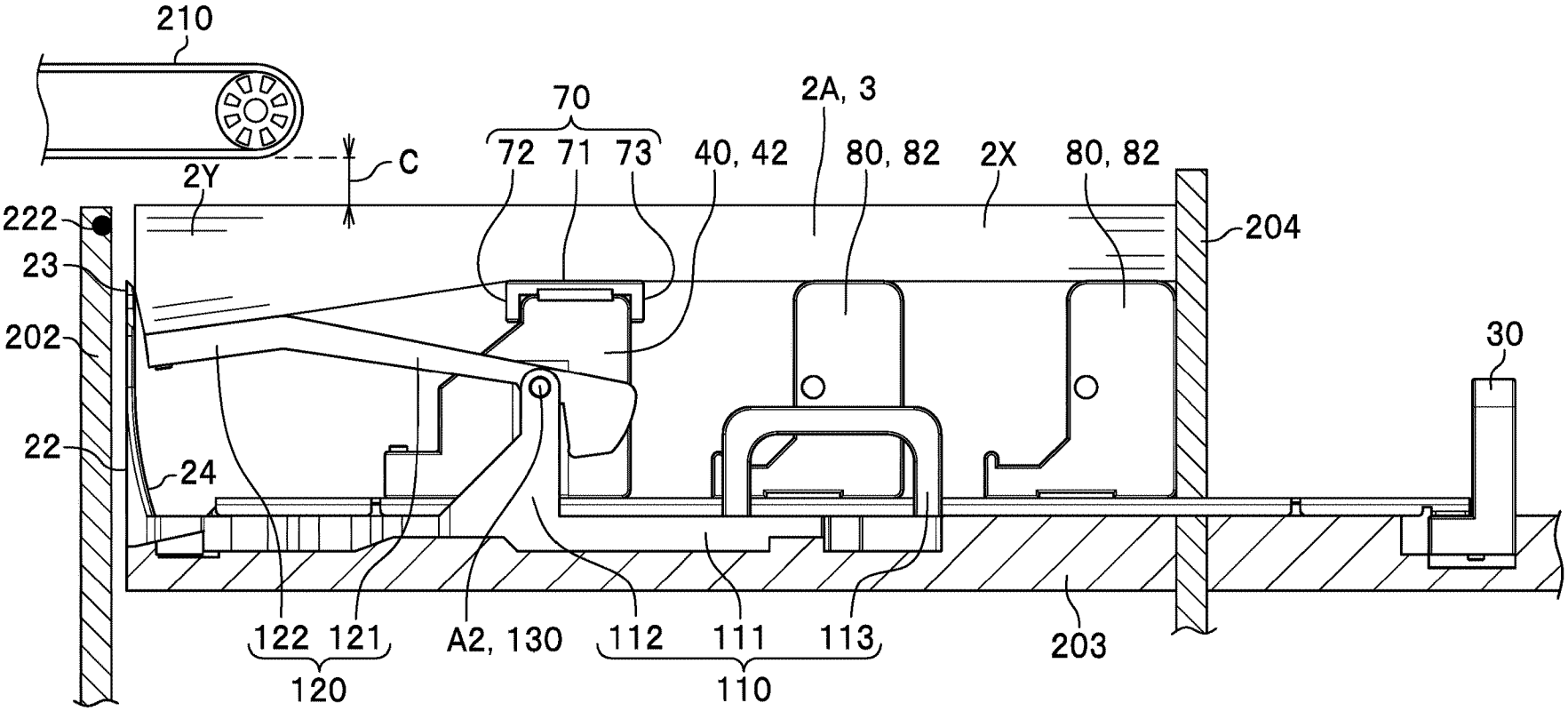
FIG. 10 is a side view schematically illustrating an example that the longitudinally-long open-end envelope is supported by the article supporter set according to the embodiment of the present invention.

As illustrated in FIG. 10, in a case where the bundle 3 becomes thinner due to outward supply of the open-end envelopes 2A of the upper part of the bundle 3, the controller 223 (see FIG. 1) causes the lifting plate 203 to lift. Each second support 50 (see FIG. 8) pivots around the pivotal shaft A1 such that the corresponding leading end 53 rises as the bundle 3 becomes lighter. Similarly, as the bundle 3 becomes lighter, the corresponding support 120 pivots around the pivotal shaft A2 such that the leading end 122 rises. At that time, the respective front ends of the remaining open-end envelopes 2A of the bundle 3 slide with respect to the rib 24. As a result, the gap C between the uppermost open-end envelope 2A of the bundle 3 and the feeder 210 is maintained at a predetermined value.

For a small number of stacked thinly tabular articles 2 of the bundle 3, the left and right raising members 70 as described above may be removed. In such a case, the portion with the thinner parts 2X superimposed of the bundle 3 is placed and supported on the side walls 42 and 42 of the corresponding first support 40.

Note that, in a case where all the open-end envelopes 2A of the bundle 3 are supplied outward, the controller 223 can stop the lifting of the lifting plate 203, due to detection of the extending wall 23 by the sensor 222.

<Technique of (Center-Seam Elongated) Open-End Envelope>

Figure 11:
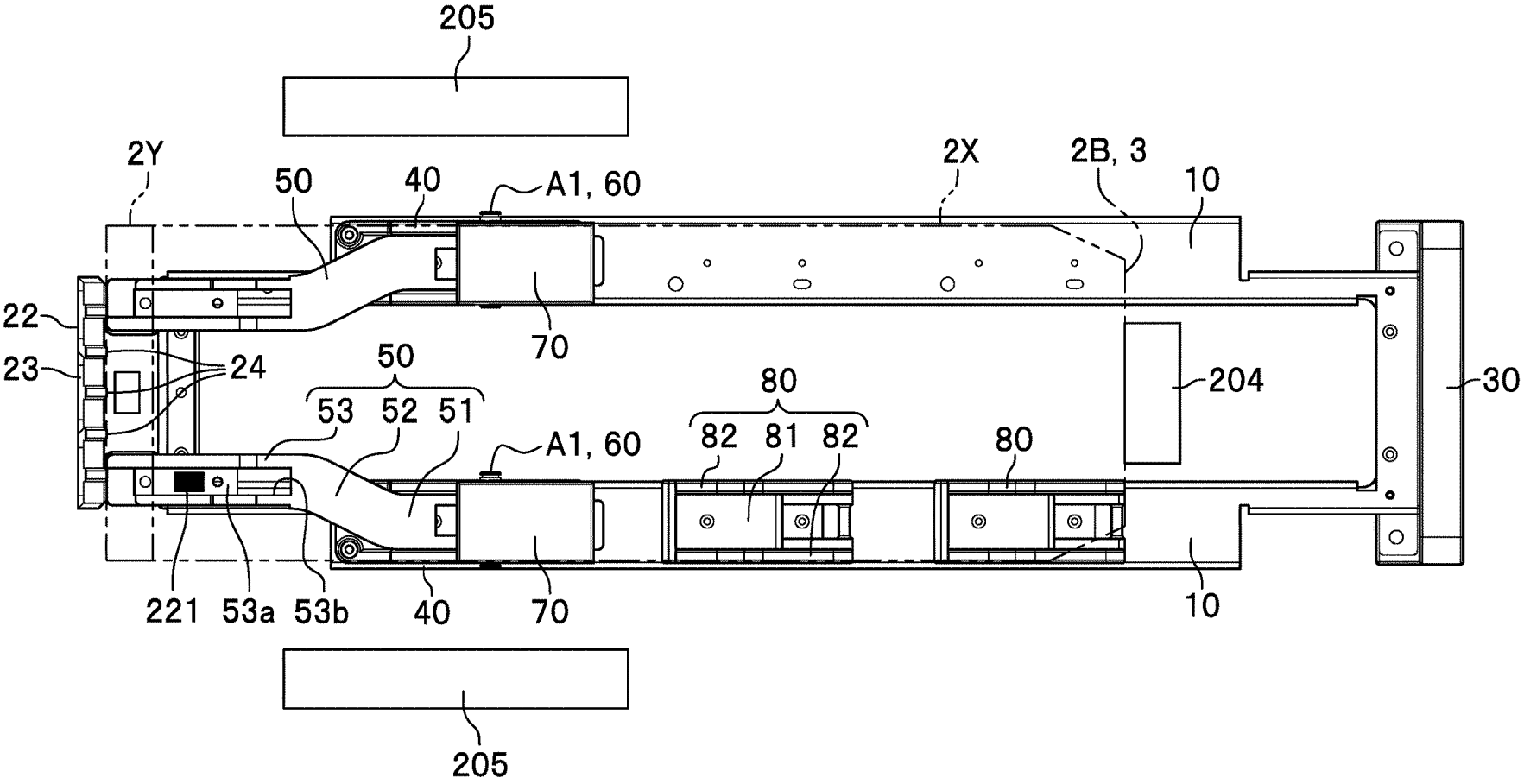
FIG. 11 is a plan view schematically illustrating an example that a center-seam elongated open-end envelope is supported by an article supporter according to an embodiment of the present invention.
Figure 12:
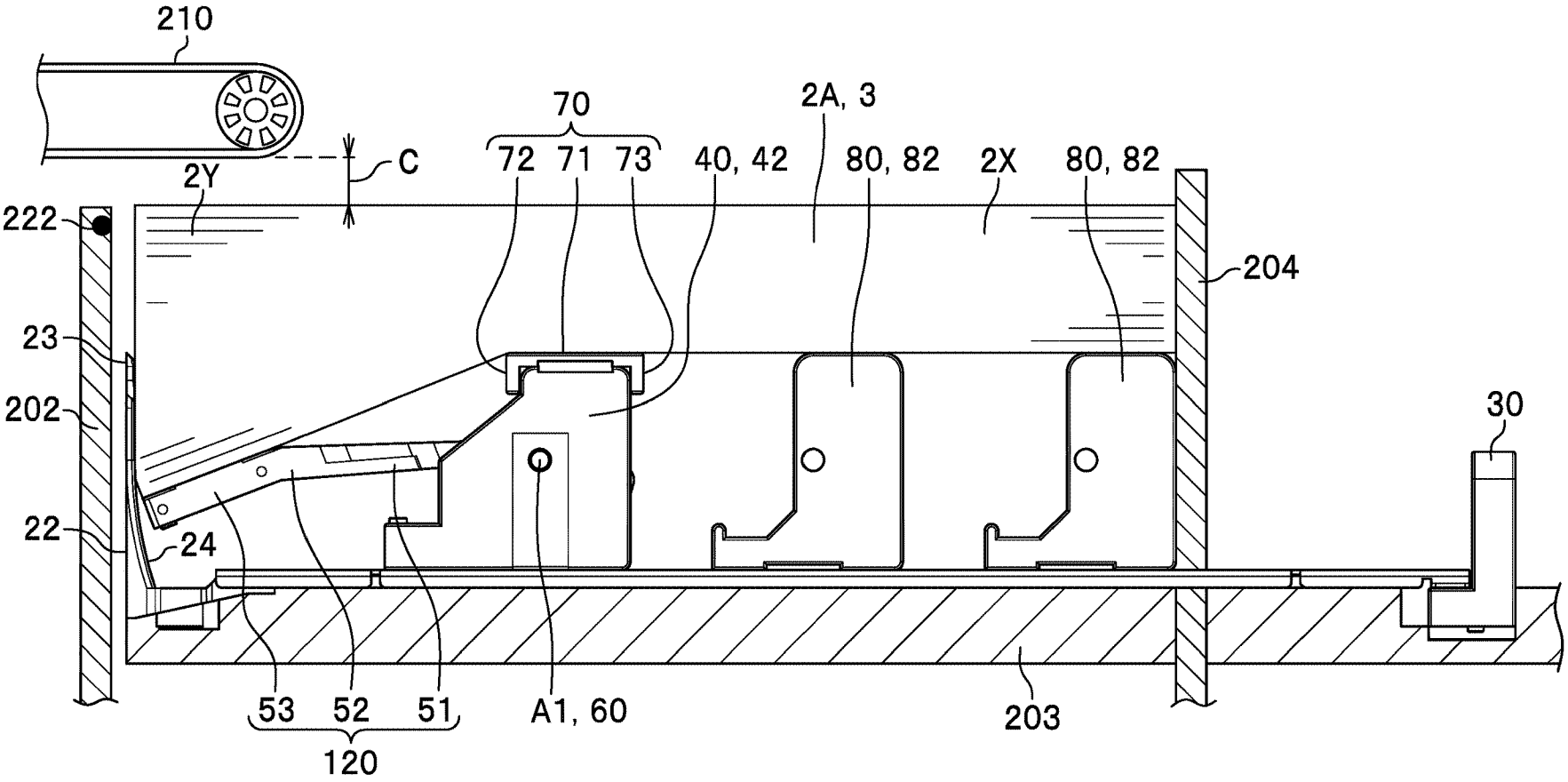
FIG. 12 is a side view schematically illustrating an example that the center-seam elongated open-end envelope is supported by the article supporter according to the embodiment of the present invention.

Next, a technique of supporting a center-seam elongated open-end envelope 2B will be described focusing on differences from the case of supporting a longitudinally-long open-end envelope 2A. In the drawings referred to in the following description, the floaters 205 and 206 and the feeder 210 are omitted appropriately. As illustrated in FIGS. 11 and 12, a bundle 3 of center-seam elongated open-end envelopes 2B stacked is supported by the article supporter 5, and is positioned by the position regulator 20, and the position regulator 204 and the floaters 205 and 205 with the positions adjusted in response to the size of the open-end envelopes 2B. Of such a center-seam elongated open-end envelope 2B as described above, the central part in the width direction as the thicker part 2Y locates between the leading ends 53 and 53 paired in the width direction. Thus, the influence on the posture of the uppermost open-end envelope 2B is small. In the example of FIG. 11, the pair of front and rear third support 80 and 80 on the right are removed. The pair of front and rear third supports 80 and 80 on the right, however, are provide on the corresponding base 10.

<Technique of (Single-Side-Seam Elongated) Open-end Envelope>

Figure 13:
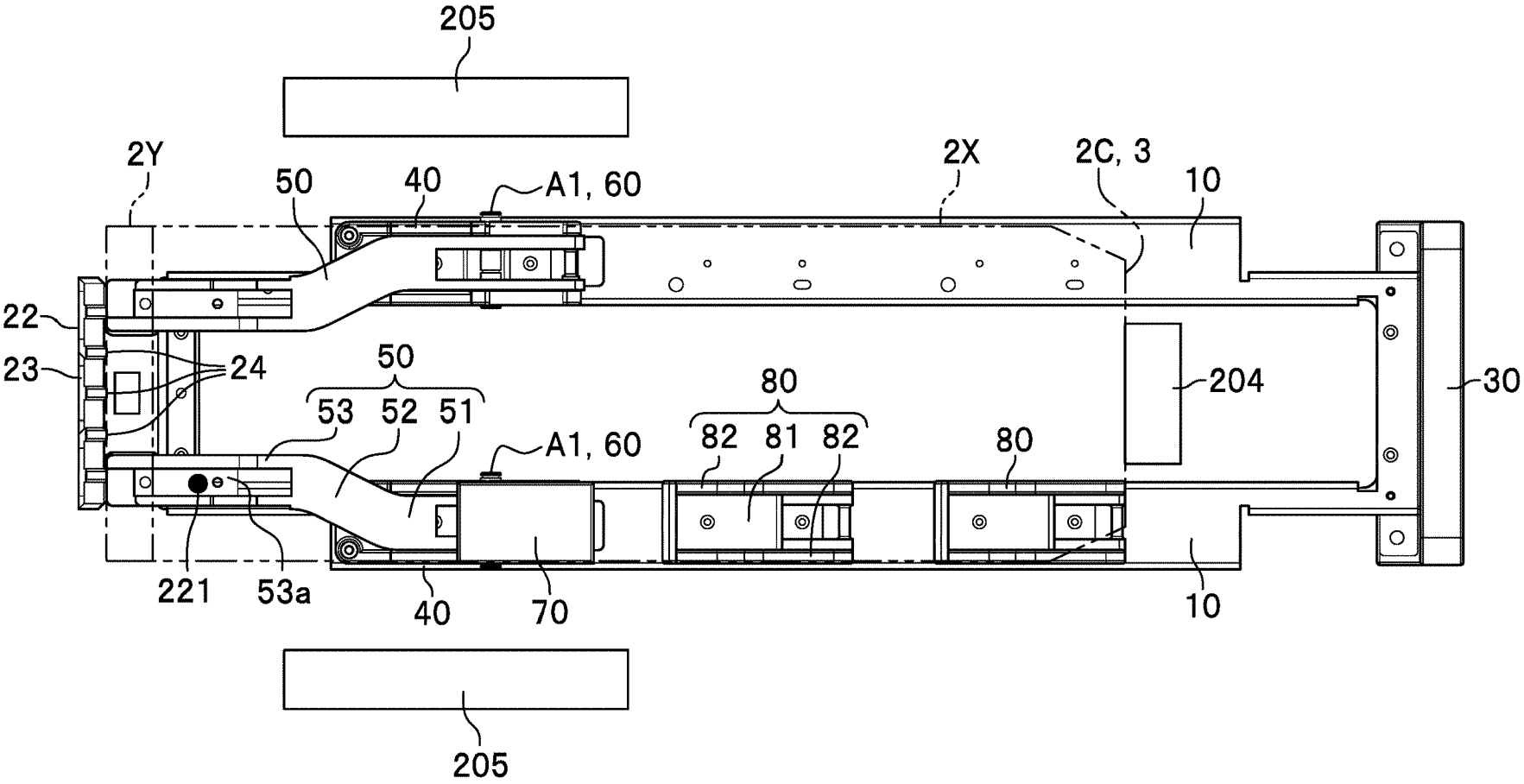
FIG. 13 is a plan view schematically illustrating an example that a single-side-seam elongated open-end envelope is supported by the article supporter according to the embodiment of the present invention.
Figure 14:
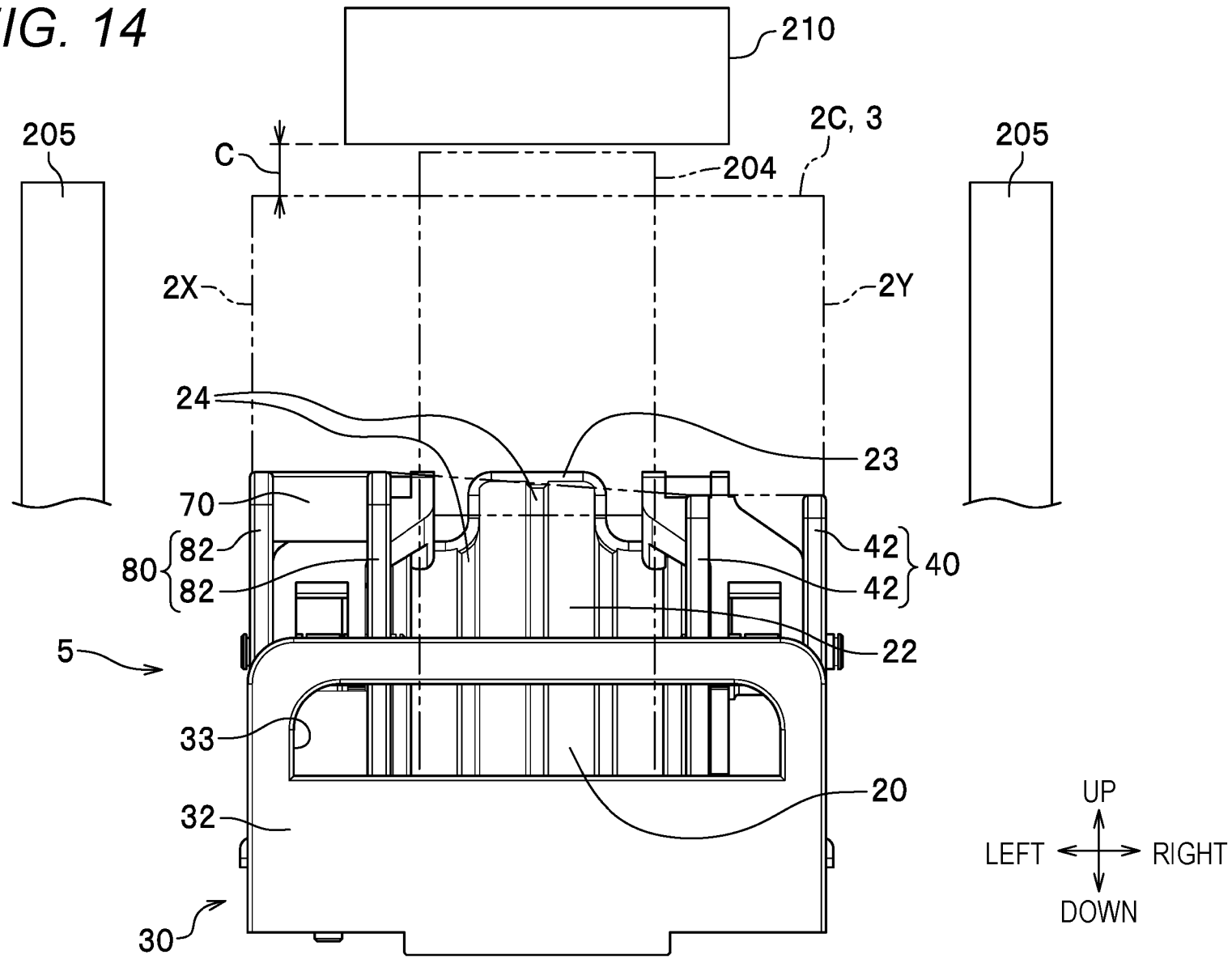
FIG. 14 is a rear view schematically illustrating an example that the single-side-seam elongated open-end envelope is supported by the article supporter according to the embodiment of the present invention.

Next, a technique of supporting a single-side-seam elongated open-end envelope 2C will be described focusing on differences from the case of supporting a center-seam elongated open-end envelope 2B. As illustrated in FIGS. 13 and 14, a bundle 3 with single-side-seam elongated open-end envelopes 2C stacked is supported by the article supporter 5, and is positioned by the position regulator 20, and the position regulator 204 and the floaters 205 and 205 with the positions adjusted in response to the size of the open-end envelopes 2C. Of the article supporter 5, the raising member 70 and each third support 80 corresponding to the one end in the width direction as the thicker part 2Y of such an open-end envelope described above 2C are removed. Such a configuration allows the article supporter 5 to cope with not only the difference in thickness of the open-end envelope 2C in the feeding direction but also the difference in thickness of the open-end envelope 2C in the width direction, so that the uppermost open-end envelope 2C can be substantially horizontal.

<Image Forming Apparatus>

The supply device 1 described above is suitably used as a device that supplies a thinly tabular article 2 to an image forming apparatus. Examples of such an image forming apparatus include a copier, a printer, a facsimile apparatus, a printing apparatus, and a multifunction peripheral. Hereinafter, a case where an image forming apparatus including the supply device 1 is applied to a copier will be described as an example.

Figure 15:
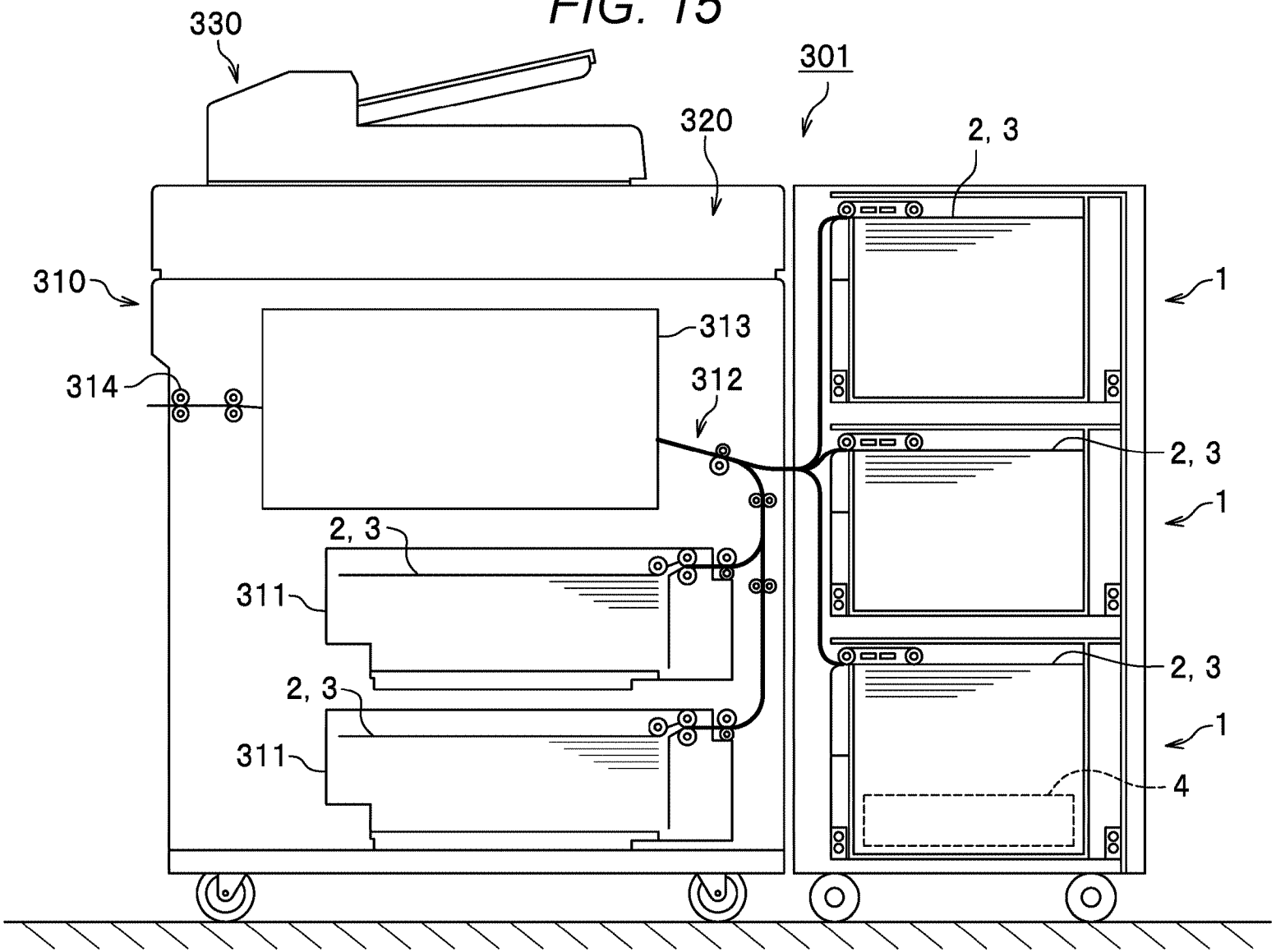
FIG. 15 is a side view schematically illustrating an image forming apparatus according to an embodiment of the present invention.

As illustrated in FIG. 15, an image forming apparatus 301 according to an embodiment of the present invention includes an image-forming-apparatus main body 310, an image reader 320, an automatic document feeder 330, and the supply device 1.

The image-forming-apparatus main body 310 includes a storage 311, a supplier 312, an image former 313, and a discharger 314. The storage 311 stores a bundle of a plurality of thinly tabular articles 2 stacked. The supplier 312 takes out a thinly tabular article 2 from the thinly tabular articles 2 stored in the storage 311 and conveys the thinly tabular article 2 to the image former 313.

The image former 313 forms an image onto the thinly tabular article 2 conveyed from the supplier 312, on the basis of an image signal transmitted from the image reader 320. As an image forming type of the image former 313, for example, an electrophotographic type or an inkjet type can be adopted. As an example, in a case where the electrophotographic type is adopted for the image former 313, the image former 313 includes a toner-image forming unit, an intermediate transfer belt, and a fixer, and forms a toner image onto one main face of the thinly tabular article 2. In a case where the inkjet type is adopted for the image former 313, the image former 313 includes an inkjet head and forms an ink image onto one main face of the thinly tabular article 2.

The discharger 314 discharges the thinly tabular article 2 with an image formed by the image former 313, outward the image-forming-apparatus main body 310.

The image reader 320 optically reads an image from a document conveyed from the automatic document feeder 330, processes a read image signal, and transmits the processed image signal to the image former 313.

The automatic document feeder 330 includes a document table and conveys a document placed on the document table to the image reader 320.

The supply device 1 is connected to the image-forming-apparatus main body 310 and supplies a thinly tabular article 2 to the image-forming-apparatus main body 310. In the present embodiment, the image forming apparatus 301 includes a plurality of such supply devices 1 as described above. Each supply device 1 separates the thinly tabular articles 2 one by one, and supplies each separated thinly tabular article 2 to the supplier 312 of the image-forming-apparatus main body 310.

The thinly tabular article 2 supported by the article supporter set 4 or the article supporter 5 is supplied to the supplier 312, with the thicker part 2Y facing frontward. The supply of the thinly tabular article 2 with the thicker part 2Y facing frontward is suitable for, for example, roller conveyance at the supplier 312 or sensor detection.

An article supporter 5 according to the embodiment of the present invention supplies a bundle 3 of a plurality of thinly tabular articles 2 that is stacked and is partially different in thickness, and includes: a first support that supports respective thinner parts 2X of the plurality of thinly tabular articles 2; a second support 50 that supports respective thicker parts 2Y of the plurality of thinly tabular articles 2 and is movable upward and downward; and an adjuster 60 that adjusts a level of the second support 50 such that the uppermost thinly tabular article 2 of the bundle 3 is set within a predetermined range R in a vertical direction.

Thus, the article supporter 5 enables suitable supporting of the bundle 3 with the plurality of thinly tabular articles 2 that is stacked and is partially different in thickness, so that the uppermost thinly tabular article 2 can take a suitable posture even for a large number of stacked thinly tabular articles 2.

In the article supporter 5, the adjuster 60 includes an urging member that urges the second support 50 upward.

Thus, the article supporter 5 enables lowering of the second support 50 downward due to the weight of the bundle 3, so that the uppermost thinly tabular article 2 can take a suitable posture.

In the article supporter 5, the second support 50 is pivotally journaled to the first support 40.

Thus, the article supporter 5 enables suitable setting of an angle of the face of the second support 50 supporting the bundle 3.

In the article supporter 5, the second support 50 includes a sensor holder 53*a* capable of a sensor 221 that detects presence or absence of the plurality of thinly tabular articles 2.

Thus, the article supporter 5 enables suitable detection of the presence or absence of the plurality of thinly tabular articles 2 supported by the article supporter 5.

The article supporter 5 further includes a raising member 70 detachably attached to an upper part of the first support 40.

Thus, the article supporter 5 enables changing of the support level of the thinner parts 2X in response to the number of stacked thinly tabular articles 2 of the bundle 3.

Further, in a case where the article supporter 5 includes first supports 40 paired in the width direction, the article supporter 5 can also suitably support a thinly tabular article 2 different in thickness in the width direction, such as a single-side-seam elongated open-end envelope 2C.

The article supporter 5 further includes a position regulator 20 that regulates, at a position lower than a position of the second support 50 not supporting the bundle 3, a position of an end of the bundle 3, the end being closer to the second support 50.

Thus, the article supporter 5 enables suitable prevention of the thinly tabular articles 2 of the bundle 3 from downstream displacement from the second support 50.

In the article supporter 5, the position regulator 20 has a face that is opposite the bundle 3 and is provided with a rib 24 extending upward and downward.

Thus, the article supporter 5 enables reduction of friction generated between the bundle 3 and the position regulator 20, so that the thinly tabular articles 2 of the bundle 3 can smoothly slide to the position regulator 20.

The article supporter 5 further includes a third support 80 that supports the bundle 3 and is opposite the second support 50 across the first support 40.

Thus, the article supporter 5 enables suitable supporting of the bundle 3 of thinly tabular articles 2 large in size in the feeding direction.

In the article supporter 5, the first support 40 includes a pair of first supports 40 and 40, the second support 50 includes a pair of second supports 50 and 50, the adjuster 60 includes a pair of adjusters 60 and 60, the first support 40, the second support 50, and the adjuster 60 are in a pair of combinations, one of the pair of combinations includes one of the pair of first supports 40 and 40, one of the pair of second supports 50 and 50, and one of the pair of adjusters 60 and 60, another of the pair of combinations includes another of the pair of first supports 40 and 40, another of the pair of second supports 50 and 50, and another of the pair of adjusters 60 and 60, and the pair of combinations are arrayed in a width direction of the bundle 3.

Thus, the article supporter 5 enables prevention of interference with a position regulator 204 that regulates the position of the end on the first support 40 side of the bundle 3 and prevention of warpage of the bundle 3 between the pair of second supports 50 and 50, resulting in suitable supporting of the bundle 3.

In the article supporter 5, the pair of second supports 50 and 50 have respective parts that support the bundle 3, the pair of first supports 40 and 40 have respective parts that support the bundle 3, and an interval between the respective parts of the pair of second supports 50 and 50 is smaller than an interval between the respective parts of the pair of first supports 40 and 40.

Thus, the article supporter 5 enables suitable positioning of the bundle 3 with the position regulator 204 large in size in the width direction.

The article supporter 5 further includes a coupler 30 that couples the pair of combinations and is provided with a handle 33.

Thus, the article supporter 5 enables facilitation of detachably attachment to a supply device 1 to which the article supporter 5 is applied.

According to the article supporter 5, each of the plurality of thinly tabular article 2 is as an envelope. Thus, the article supporter 5 enables suitable supporting of an envelope partially different in thickness.

A supply device 1 according to the embodiment of the present invention includes: the article supporter 5; and a feeder 210 that supplies, by air suction, an uppermost thinly tabular article 2 from a bundle 3 of a plurality of thinly tabular articles 2 that is stacked and is partially different in thickness, the bundle 3 being supported by the article supporter 5.

Thus, the uppermost thinly tabular article 2 as a feeding target is supported suitably, so that the article supporter 5 enables suitable feeding of the thinly tabular article 2.

The supply device 1 further includes floaters 205 and 206 that float the uppermost thinly tabular article 2 from the bundle 3 supported by the article supporter 5, and the feeder 210 feeds the floated thinly tabular article 2.

Thus, the uppermost thinly tabular article 2 as a feeding target is supported in a suitable posture, so that the article supporter 5 enables suitable floating and supplying of the thinly tabular article 2.

In the supply device 1, the second support 50 is disposed downstream of the first support 40 in the feeding direction of the plurality of thinly tabular articles 2.

Thus, the supply device 1 enables supplying of each thinly tabular article 2 with the thicker part 2Y facing frontward.

The supply device 1 further includes a lifting plate 203 movable upward and downward, and the article supporter 5 is provided on the lifting plate 203.

Thus, the supply device 1 can move the lifting plate 203 in response to the number of stacked thinly tabular articles 2 of the bundle 3 to disposed the uppermost thinly tabular article 2 at a position suitable for feeding.

An image forming apparatus 301 according to the embodiment of the present embodiment includes: the supply device 1; and an image former 313 that forms an image on each of the plurality of thinly tabular articles 2 supplied from the supply device 1.

Thus, because the uppermost thinly tabular article 2 as an image forming target is supported in a suitable posture, the image forming apparatus 301 enables suitable supplying of the thinly tabular article 2 to form suitably an image on the thinly tabular article 2.

Although embodiments of the present invention have been described and illustrated in detail, the disclosed embodiments are made for purposes of illustration and example only and not limitation. The scope of the present invention should be interpreted by terms of the appended claims, and thus can be appropriately changed without departing from the gist of the present invention.

What is claimed is:

1. An article supporter for a supply device including a feeder that supplies, by air suction, an uppermost thinly tabular article from a bundle of a plurality of thinly tabular articles that is stacked and is partially different in thickness, the article supporter for supporting the bundle with a gap between the uppermost thinly tabular article and the feeder, the article supporter comprising:

a first support that supports respective thinner parts of the plurality of thinly tabular articles;

a second support that supports respective thicker parts of the plurality of thinly tabular articles and is movable upward and downward; and an adjuster that adjusts a level of the second support such that the uppermost thinly tabular article of the bundle is set within a predetermined range in a vertical direction, wherein the second support is disposed downstream of the first support in a feeding direction of the feeder, wherein each of the plurality of thinly tubular articles is an envelope, wherein the second support supports a bottom part of the envelope, and wherein the envelope is fed with the bottom part facing downstream in the feeding direction.

2. The article supporter according to claim 1, wherein the adjuster includes an urging member that urges the second support upward.

3. The article supporter according to claim 1, wherein the second support is pivotally journaled to the first support.

4. The article supporter according to claim 1, wherein the second support includes a sensor holder capable of holding a sensor that detects presence or absence of the plurality of thinly tabular articles.

5. The article supporter according to claim 1, further comprising a raising member detachably attached to an upper part of the first support.

6. The article supporter according to claim 1, further comprising a position regulator that regulates, at a position lower than a position of the second support not supporting the bundle, a position of an end of the bundle, the end being closer to the second support.

7. The article supporter according to claim 6, wherein the position regulator has a face that is opposite the bundle and is provided with a rib extending upward and downward.

8. The article supporter according to claim 1, further comprising a third support that supports the bundle and is opposite the second support across the first support.

9. The article supporter according to claim 1, wherein the first support includes a pair of first supports, the second support includes a pair of second supports, the adjuster includes a pair of adjusters, the first support, the second support, and the adjuster are in a pair of combinations, one of the pair of combinations includes one of the pair of first supports, one of the pair of second supports, and one of the pair of adjusters, another of the pair of combinations includes another of the pair of first supports, another of the pair of second supports, and another of the pair of adjusters, and the pair of combinations are arrayed in a width direction of the bundle.

10. The article supporter according to claim 9, wherein the pair of second supports have respective parts that support the bundle, the pair of first supports have respective parts that support the bundle, and an interval between the respective parts of the pair of second supports is smaller than an interval between the respective parts of the pair of first supports.

11. The article supporter according to claim 9, further comprising a coupler that couples the pair of combinations and is provided with a handle.

12. A supply device comprising:

the article supporter according to claim 1; and a feeder that supplies, by air suction, an uppermost thinly tabular article from a bundle of a plurality of thinly tabular articles that is stacked and is partially different in thickness, the bundle being supported by the article supporter.

13. The supply device according to claim 12, further comprising a floater that floats the uppermost thinly tabular article from the bundle supported by the article supporter, wherein the feeder feeds the floated uppermost thinly tabular article.

14. The supply device according to claim 12, further comprising a lifting plate movable upward and downward, wherein the article supporter is provided on the lifting plate.

15. An image forming apparatus comprising:

the supply device according to claim 12; and an image former that forms an image on each of the plurality of thinly tabular articles supplied from the supply device.

* * * * *